US005431079A

United States Patent [19]

Bunker

[11] Patent Number: 5,431,079

[45] Date of Patent: Jul. 11, 1995

[54] FULL-DUMPING TREMOLO GUITAR

[76] Inventor: David D. Bunker, 217 S. 3rd St. (Rte. 309), Coopersburg, Pa. 18036

[21] Appl. No.: 184,947

[22] Filed: Jan. 21, 1994

[51] Int. Cl.[6] ..... G10D 3/00

[52] U.S. Cl. ..... 84/313

[58] Field of Search ..... 84/298, 307, 313

[56] References Cited

U.S. PATENT DOCUMENTS 4,643,070 2/1987 Petrillo ..... 84/313

4,882,967 11/1989 Rose ..... 84/313

*Primary Examiner*—M. L. Gellner

*Assistant Examiner*—Patrick J. Stanzione

*Attorney, Agent, or Firm*—Synnestvedt & Lechner

[57] ABSTRACT

A full-dumping tremolo guitar is provided with a recess extending only part way through the body of the guitar, in which recess are located the springs for balancing the pivotable bridge against the string tension. The screws for adjusting the spring tension are accessible from the front of the guitar when the bridge is pivoted upwardly, in the direction to loosen the strings. The bridge and its supporting structure are readily removable from their connection to the springs in the recess, for adjustment or replacement, and the top bridge itself is readily removable from its supporting structure for replacement purposes. The construction is such that relatively long springs can be used with a relatively short recess. The smooth, undisturbed surface of the back of the guitar contributes to the appearance and tonal quality of the guitar. The base pick-up preferably overlies a portion of the same recess which contains the springs.

2 Claims, 5 Drawing Sheets

FULL-DUMPING TREMOLO GUITAR

FIELD OF THE INVENTION

This invention relates to stringed instruments which use a bridge pivotable during playing to vary the pitch of all strings which traverse the bridge, for example to produce a tremolo effect, and which provide for complete relief of the string tension to achieve a full-dumping operation.

BACKGROUND OF THE INVENTION

Stringed instruments such as guitars are known in which the bridge is mounted so that by manual operation of a "trem bar", the bridge can be pivoted about an axis transverse to the strings during playing, thereby to vary the tension on all strings simultaneously; the result is a controlled variation of the pitch of all strings, whereby distinctive sound effects, such as a wavering pitch known as tremolo can be produced, as an example. In a full-dumping guitar the tension of the strings can be completely relieved by pivoting the bridge, which is known as full-dumping.

One way in which this has been accomplished has been to mount a pivotable bridge in an opening extending completely through the guitar, along with adjustable springs mounted in the rear of the recess and accessible from the rear, which springs urge the bridge in the direction to tighten the springs; typically the pivoting torque exerted on the bridge by the springs just balances the oppositely-directed torque exerted by the strings, so that the bridge "floats" in a balanced equilibrium position when no disturbing external force is applied, from which position it can be pivoted in either direction by a lever or "trem bar" extending outward from the front face of the instrument, thereby to produce the desired manually-controlled variation in pitch of all strings. In order to maintain the desired balance, i.e. the appropriate spring tension to counteract the string tension, the guitar is provided with a rear cover which is removed so adjustment of spring tensions can be made from the rear side of the instrument.

In addition, the bridge structure is typically of one piece with its underlying support, and therefore causes difficulties in changing the bridge itself, making it difficult for example to substitute a wooden string-engaging bridge for a metal or plastic one, or vice versa.

It is therefore desirable, among other things, to provide a stringed instrument of the tremolo type in which adjustment of the springs and replacement of the bridge are easier, manufacture of the entire instrument is easier and less expensive, and the tonal quality of the instrument is not compromised by requiring use of a covered opening in the back of the guitar.

SUMMARY OF THE INVENTION

In accordance with the present invention, a tremolo stringed instrument is provided having a recess in its front face extending only part-way through the instrument, and over which the bridge is pivotably mounted; in the same recess there is mounted the spring system which tends to pivot the bridge structure in the direction to tighten the strings. This spring system comprises spring-tension adjusting means which are accessible for adjustment from the front of the instrument when the tremolo bar is pressed to rotate the bridge structure in the direction to loosen the strings. In the preferred embodiment, normal tuning can be performed at the head end of the guitar, and optionally, fine tuning can optimally be provided at the body end of the guitar. The bridge is mounted so it can be easily removed and replaced by any of various other bridge types and materials. The numerous other advantages of the new guitar are set forth in detail later herein.

BRIEF DESCRIPTION OF THE DRAWINGS

These and other objects and features of the invention will be more readily understood from a consideration of the following detailed description, taken with the accompanying drawings, in which.

DETAILED DESCRIPTION OF PREFERRED EMBODIMENTS

Figure 1A:
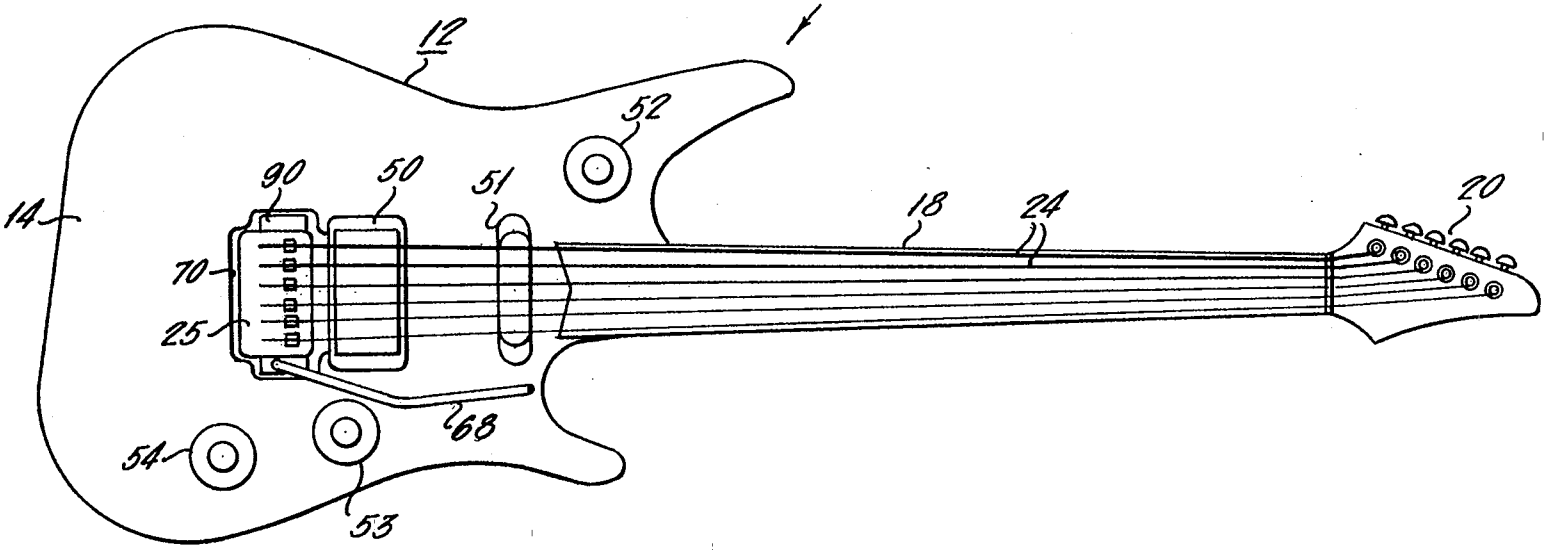
FIG. 1A is a top view of a guitar embodying the invention.
Figure 1B:
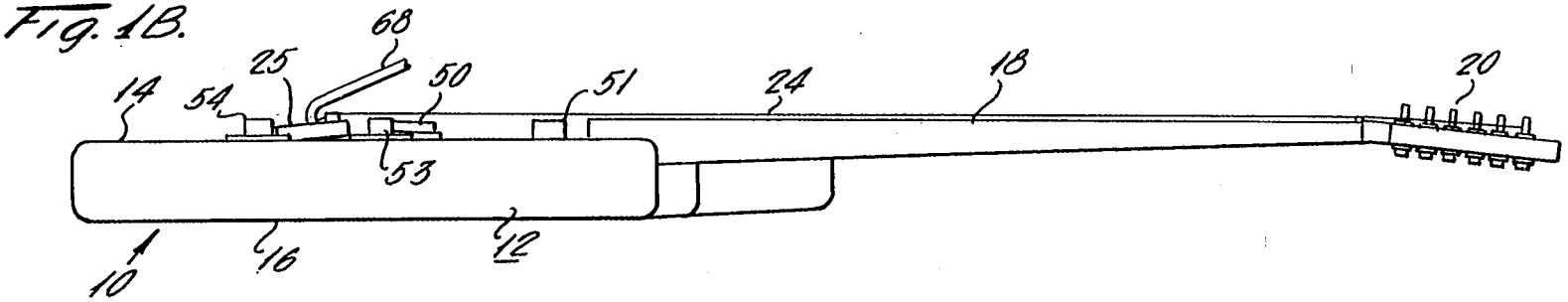
FIG. 1B is a side view of the guitar of FIG. 1A.
Figure 1C:
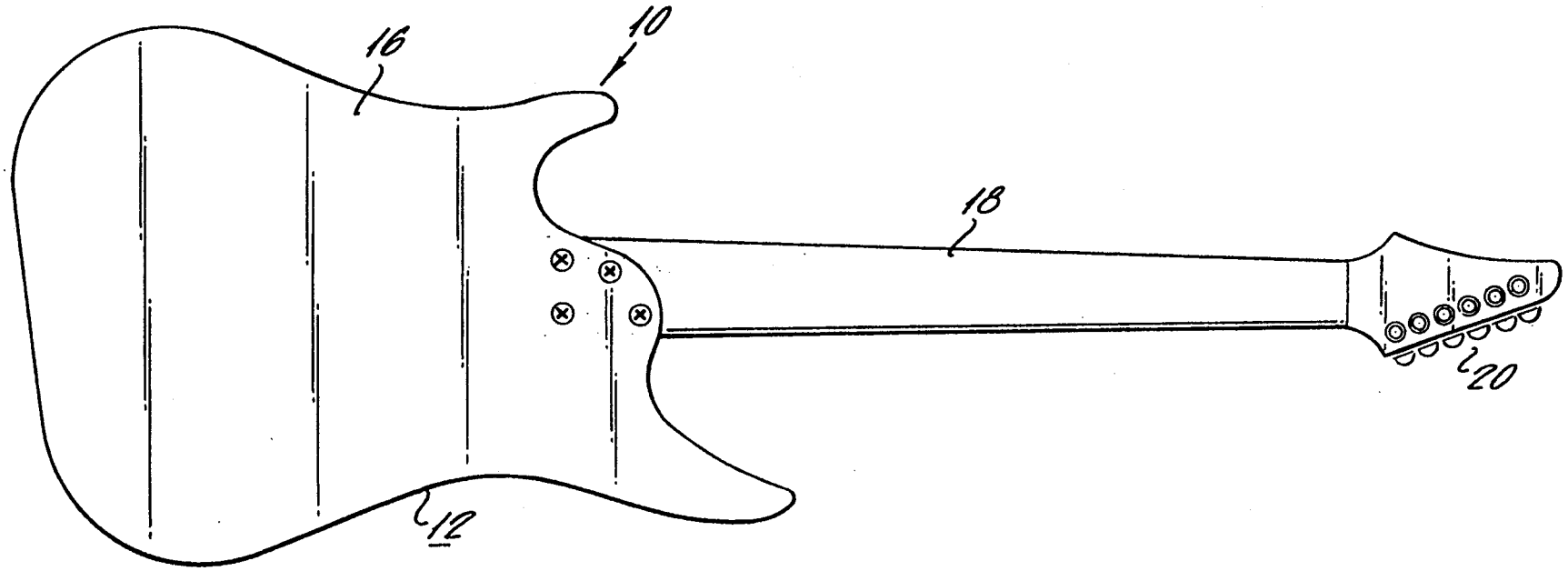
FIG. 1C is a rear view of the guitar of FIG. 1A.
Figure 1D:
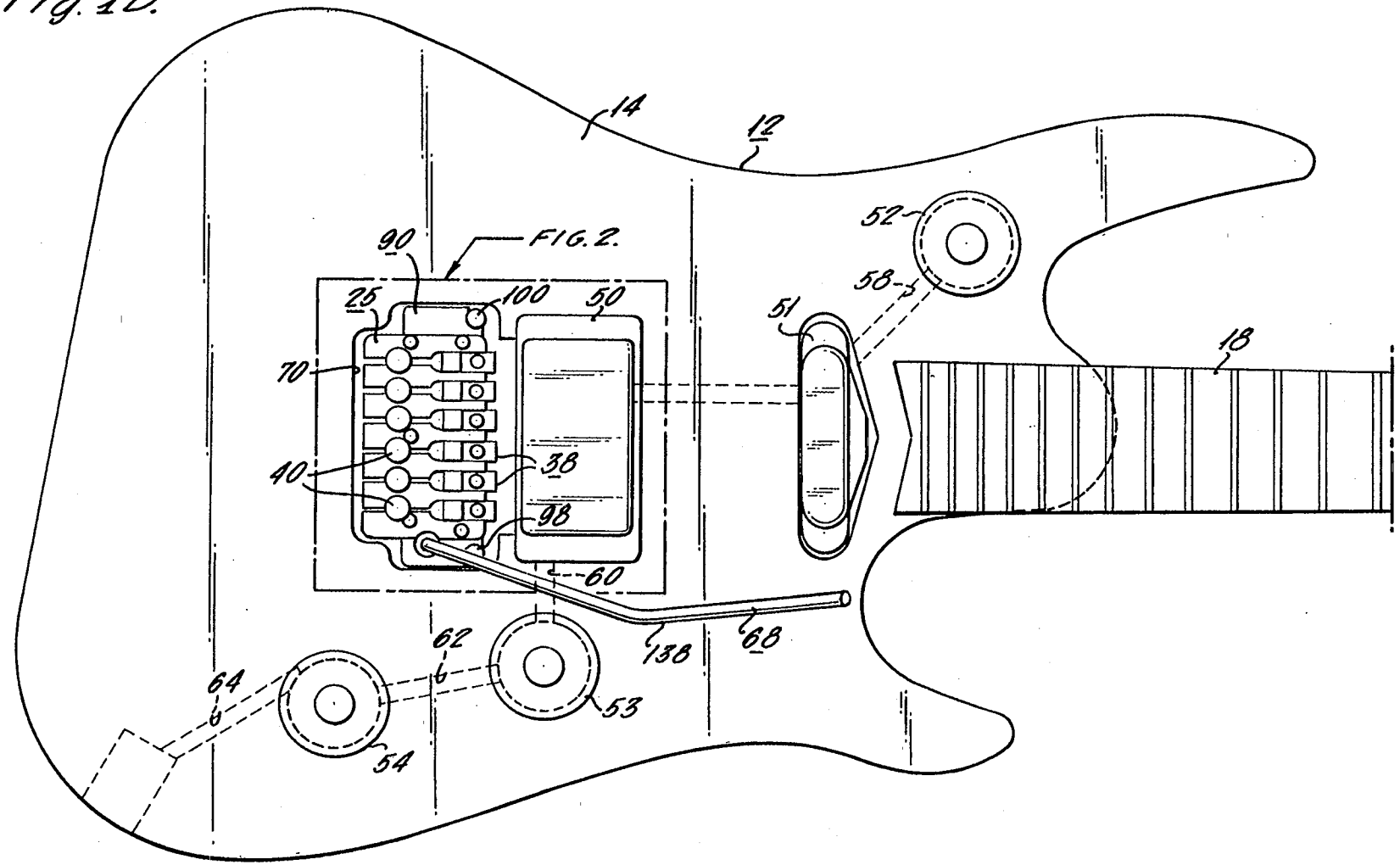
FIG. 1D is an enlarged fragmentary view showing the front of the guitar of FIG. 1A in more detail.
Figure 3:
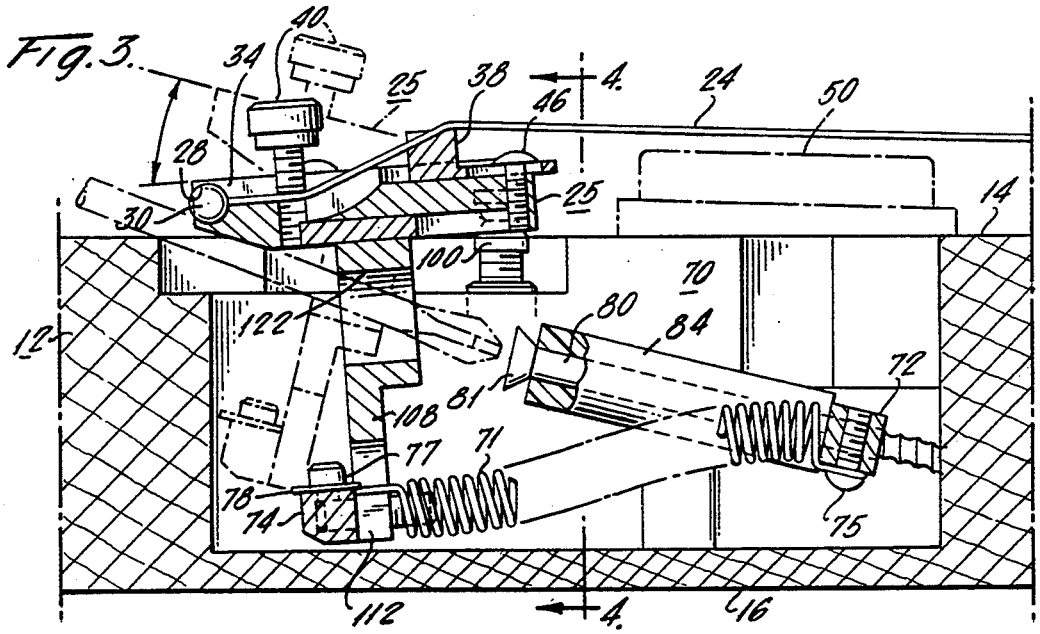
FIG. 3 is a sectional view taken along lines 3—3 of FIG. 2.

Referring now to the preferred embodiment of the invention shown in the figures by way of example only, the guitar 10 comprises a main body 12 having a front face 14, and a smooth continuous and uninterrupted rear face 16; a finger board 18, with string-tuning means such as 20 at its distal end, which in this example may be of the locking machine head type. The strings such as 24, in this example six in number, extend from the string-tuning means 20 to a bridge 25 which is provided with a string retainer such as 28 for each string (see FIG. 1D for details); in this example each string is provided with a ball such as 30 (FIG. 3) at its end, which holds the string from being pulled through its associated slot such as 34 (also FIG. 3) when placed under tension. The bridge 25 is mounted on the front of the guitar, and carries adjustable intonators such as 38, one for each string, the string in each case extending over and against the top of its corresponding intonator. Preferably, fine tuning of each string is enabled by a fine-tuning screw such as 40 (FIG. 3) screw-threaded into the top of the bridge in a position such that, by screwing it downwardly, it presses the underlying string downwardly to sharpen the pitch of the string, and vice versa when it is screwed upwardly. The intonators 38 are mounted on the bridge by screws such as 46 (FIG. 6) which pass through slots such as 49 in the bridge which extend parallel to the strings, whereby each intonator can be adjusted without changing the pitch of the corresponding string by loosening its screw, sliding the intonator along the bridge, and then re-tightening the screw.

Also mounted on the front of the guitar are a bridge pick-up 50 adjacent to the bridge and a second pick-up 51 nearer the fingerboard, for responding to the vibration of the strings to produce corresponding electrical signals for amplification and subsequent application to a speaker system, thereby to provide audible dissemination of the music being performed by the player. Manual control knobs 52, 53 and 54 (FIG. 1D) are provided to adjust volume and tone, and to switch pick-ups. Interconnections between the controls and the guitar electrical output are provided by way of channels 58, 60, 62, 64 buried within the guitar body.

The bridge 25 is mounted on the guitar so that by pressing down on the trem bar 68, the bridge pivots and tilts upwardly away from the guitar face to loosen the strings, and by releasing the trem bar the bridge returned to its original position and re-tightens the strings. The degree of pivotal motion is such that the string tension can be completely relieved, so as to accomplish what is known as a "full dump", rather than just a minor variation in tension to produce only a tremolo effect.

Figure 2:
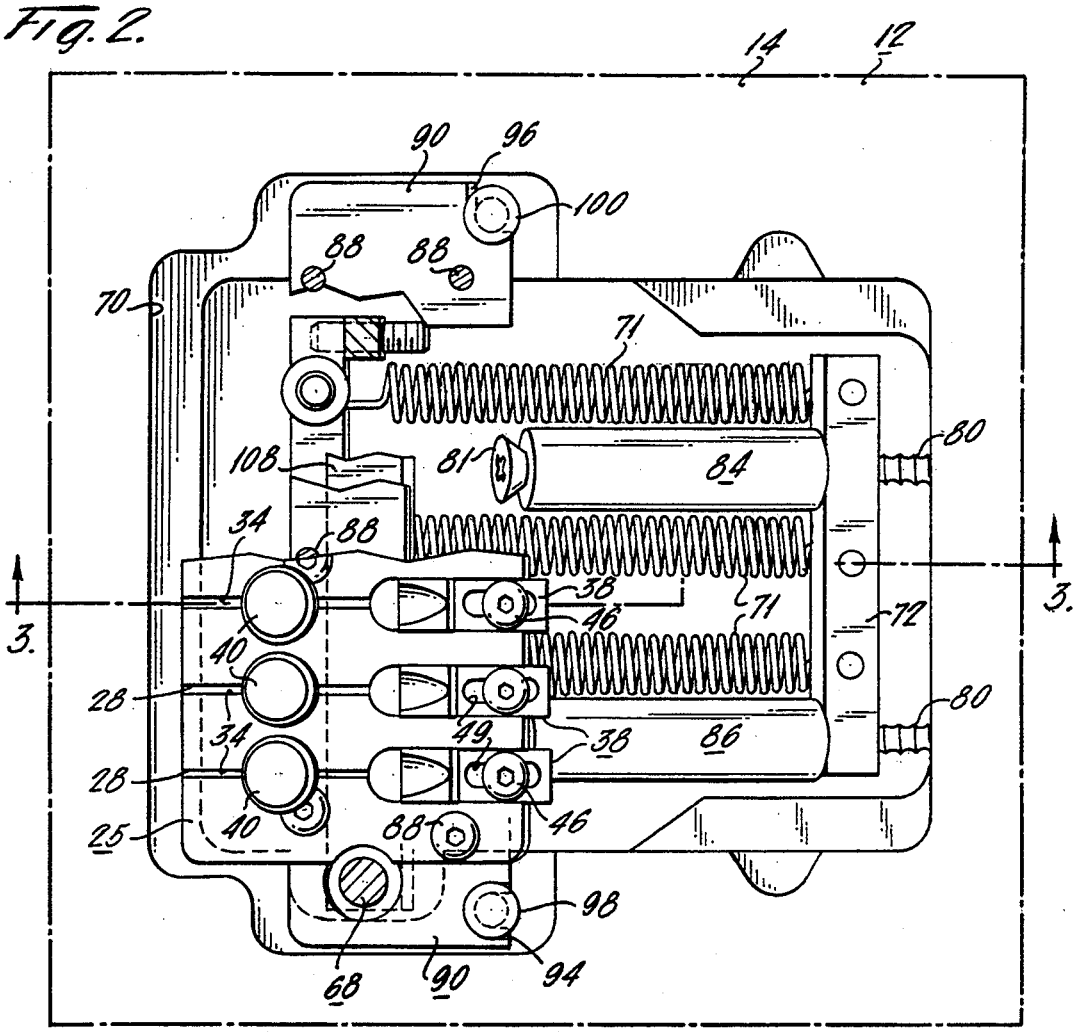
FIG. 2 is an enlarged fragmentary view of the portion of the guitar shown inside the broken-line block in FIG. 1D.

The bridge system of the invention is mounted in the front-opening, closed-back recess 70 (FIGS. 2 and 3), which extends only part way through the thickness dimension of the guitar main body. Where, as in this example, the main body is solid rather than hollow, the recess can be formed by routing with a wood router, but it can be made by forming the main guitar body of successive bonded lamina of wood, each lamina except the rear one being cut out in the shape of the cross section of the recess, so that when placed on top of each other and bonded together by a suitable adhesive they form the desired recess.

In the recess 70 there are mounted a plurality of spiral springs 71, in this example three of them, mounted at one end on a first crossbar 72 (see FIG. 2) by screws such as 75 (FIG. 3), and at the other end on a second crossbar 74 by screws and washers such as 77 and 78. Bar 72 is mounted to the wood of the guitar body near one end of the recess 70 by a pair of adjustable fasteners such as 80, in this case comprising wood screws the slotted heads such as 81 of which are spaced from crossbar 72 by respective spacer cylinders 84 and 86. The three springs 71 are used to oppose the tension which the strings exert on the bridge, as described below.

The bridge 25 is mounted, by five screws 88, on a hard-metal pivot plate 90 which extends laterally beyond the bridge on both sides, and is provided at its forward corners (facing the fingerboard) with a first horizontal knife-edge structure 94 and a second horizontal knife-edge structure 96. Knife edge structure 94 is substantially semicircular, while knife-edge 96 is substantially quarter-circular, as an aid in slipping the entire bridge and supporting structure into and out of the position shown. These knife-edge structures mate with, and pivot in, a corresponding pair of pivot anvils 98 and 100 threaded into the wood of the guitar front on opposite sides of the bridge. Each pivot anvil has a frustobiconical shape with its axis vertical, and the two knife edges of the pivot plate fit part-way around the anvils at their minimum diameters, to establish a horizontal pivot axis transverse to the strings for the pivot plate and the bridge carried on it.

Figure 4:
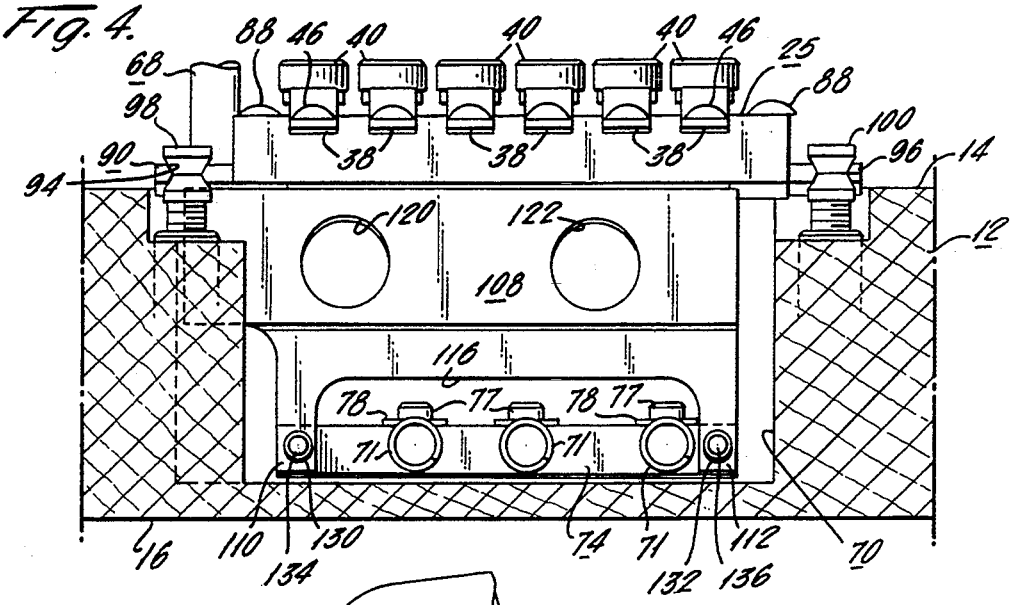
FIG. 4 is a sectional view taken along lines 4—4 of FIG. 3.
Figure 5:
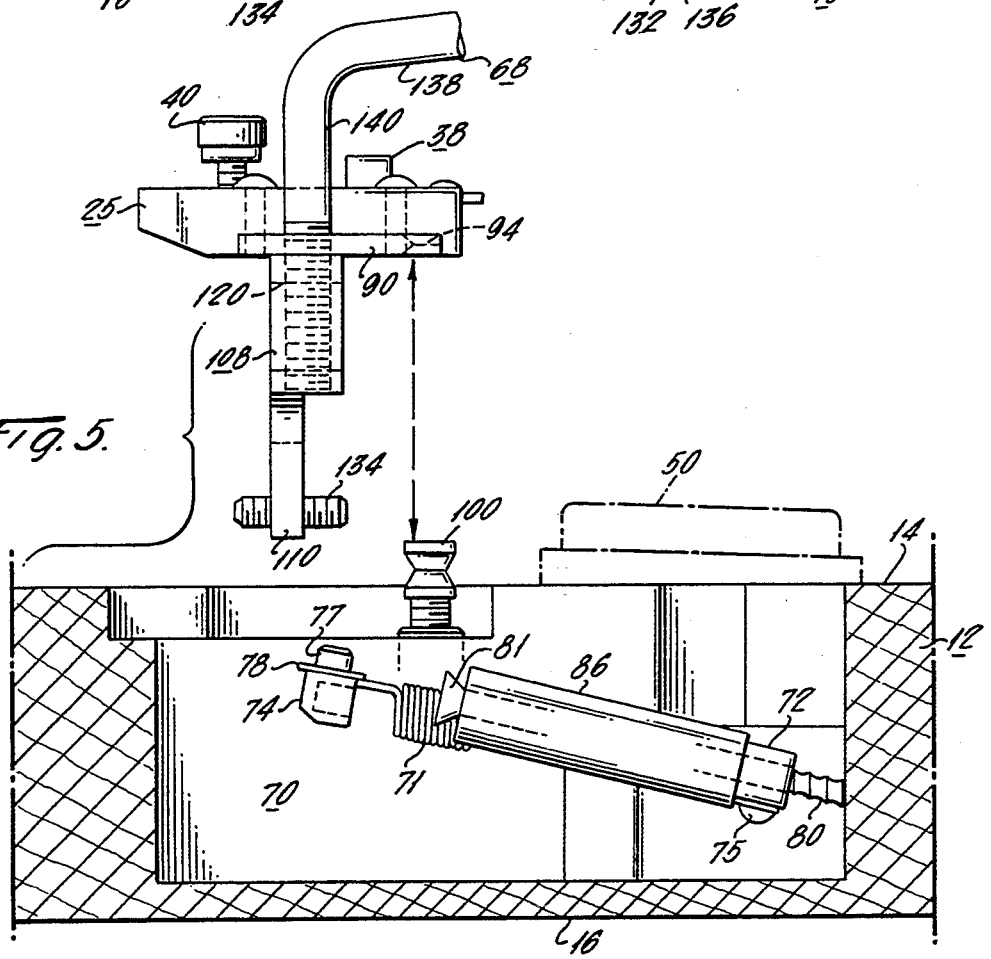
FIG. 5 is an exploded version of the view shown in FIG. 3.

Beneath the bridge and the pivot plate and extending at right angles therefrom into the recess 70 is an actuator plate 108 (FIG. 4) having two downwardly-extending arms 110 and 112 between which a cut-away region 116 provides a passage for springs 71. Above this passage are two through holes 120 and 122 large enough to accommodate the shaft of a screwdriver, and as will be seen they are aligned so that when the bridge is tilted up, a screwdriver can be inserted through the holes to turn the screws such as 80, and thereby adjust the longitudinal position of the springs, and hence the tension which they exert on the actuator plate 108, as now to be described.

Arms 110 and 112 of the actuator plate 108 are provided with threaded through holes 130 and 132 (FIG. 4) in which threaded stubs 134 and 136 are adjustably held, and from which they extend outwardly. Stubs 134 and 136 are seated in corresponding loosely-fitting openings in the crossbar 74 so that when the assembly of bridge 25, pivot plate 90 and actuator plate 108 is pivoted upwardly, the springs 71 are stretched and hence exert a restraining spring force. Trem bar 68 has a horizontal portion 138 and a vertical end portion 140 threaded into the top of actuator plate 108, so that by manual up-and-down motion of the trem bar the bridge and bridge support structure can be pivoted on the knife edges 94 and 96.

As the strings are being initially tuned, the bridge structure will tend to be pivoted somewhat upwardly by the tension of the strings; to adjust the springs so that the bridge structure "floats" in an equilibrium between string tension and spring tension, the trem bar is pressed to raise the bridge structure sufficiently to expose the heads of the screws 80 through the holes 120 and 122 in the actuator plate, whereby a screwdriver can be inserted through the holes to adjust the screws and thereby set the spring tension to balance it against the string pressure. If in some cases it is only desired to dump the strings at certain times, the springs can be adjusted normally to hold the bridge structure in one extreme position, as against a stop, in which it maintains full string tension, the "trem bar" then constituting in effect a dump bar which can only be operated in one direction from its rest position.

Various of the advantages of the new guitar can now more readily be appreciated;

(1) The springs which counteract the string tension can be more readily adjusted then in guitars in which they can only be accessed through a removable plate on the back of the guitar; one need merely operate the trem bar to lift the bridge structure above the front face of the guitar so that a screwdriver shaft can be inserted through the holes 120 and 122 in the actuator plate to adjust the screws 80.

(2) The sound and appearance of the instrument are improved due to its intact rear side, as compared with a guitar in which there is a covered hole in the back of the guitar.

(3) The full-dump tremolo bridge structure of the invention can be readily installed on nearly any standard type of electric guitar body.

(4) The bridge section of the bridge system is easily removable by removing five screws, so the system can readily be optionally used with a different type of bridge. e.g. one of wood, aluminum, steel, etc. for different types of effects; also,by using an electrically insulating bridge material, the structure of the invention can be used with instruments such as the touch-guitar which require electrical insulation of each string from the other.

(5) The guitar of the invention is especially easy and economical to manufacture.

(6) The intonators such as 38 are easily adjustable in position without detuning the guitar.

(7) The cut-away portion of the actuator plate in the bridge system permits the springs to extend through the actuator bar, and thus uses a shorter recess in the guitar main body than when the springs are required to be entirely on one side of the actuator plate.

(8) Strings are easily removable by merely tilting the bridge structure forwardly by means of the trem bar, and then popping the ball ends of the strings out of their retainers.

(9) Fine tuning can be provided, optionally, at the head end of the guitar as described.

(10) Locking nuts are not required for the strings at the distal end of the fingerboard.

(11) The threaded stubs 134 and 136 can be adjusted by screwing them in either direction in the holes 130 and 132, as a further means of adjusting the spring tension.

(12) The feature of connecting the actuator plate to the cross-bar 74 by means of the threaded stubs 134 and 136 is important in that it permits the easy removal of the entire bridge assembly of actuator plate 108, pivot plate 90 and top bridge 25 as a unit, for example, to accomplish the adjustment of the threaded stubs as described in paragraph (11) above, or to remove the top bridge 25 for repair or replacement.

While the invention has been described with particular reference to specific embodiments in the interest of definiteness, it may be embodied in a variety of diverse forms without departing from the invention as defined by the claims.

What is claimed is:

1. In a pivotable-bridge type of guitar comprising a main guitar body, a fingerboard extending from one end of said main body, a plurality of strings extending along and over said fingerboard, first string-retaining means adjacent to the distal end of said fingerboard for retaining one end of said strings, a bridge on said main body of said guitar over which said strings extend, second string-retaining means supported on said bridge for retaining the opposite ends of said strings, a bridge-support system comprising pivot means mounting said bridge for pivoting motion about an axis transverse to said strings to effect controlled tightening and loosening of all of said strings simultaneously, and spring means mounted at one end to said main body of said guitar and at the other end to said bridge-support system and urging said bridge pivotally about said axis in the direction to tighten said strings, the improvement wherein:

said main body of said guitar contains a hollowed-out recess extending only part-way through said main body from the front thereof and over which said bridge is mounted, with said springs positioned in said recess beneath said bridge, and wherein said bridge-supporting means comprises an actuator plate secured to the underside of said bridge and extending downwardly into said recess, said other end of said spring means secured to said actuator plate; said bridge-supporting means also comprising screwdriver-adjustable means for adjusting the tension provided by said spring means; said actuator plate having openings therethrough which, when said bridge is pivoted upward against said spring tension, are aligned with said screwdriver-adjustable means, to permit insertion of a screwdriver shaft and adjustment of said tension from the front of said guitar.

2. The guitar of claim 1, wherein said actuator plate has a cut-out portion through which said spring means extend, thereby permitting shortening of said recess.

* * * * *